US006701592B2

(12) United States Patent
Veloce

(10) Patent No.: US 6,701,592 B2
(45) Date of Patent: Mar. 9, 2004

(54) MULTIFIBROUS TOY AND METHOD OF MANUFACTURE THEREOF

(76) Inventor: Frank M. Veloce, 5987 Ochonski Road, Orono, Ontario (CA), L0B 1M0

( * ) Notice: Subject to any disclaimer, the term of this patent is extended or adjusted under 35 U.S.C. 154(b) by 0 days.

(21) Appl. No.: 10/347,333

(22) Filed: Jan. 21, 2003

(65) Prior Publication Data

US 2003/0135968 A1 Jul. 24, 2003

(51) Int. Cl.[7] ..... D04D 7/06
(52) U.S. Cl. ..... 28/147; 223/46; 428/4
(58) Field of Search ..... 28/140, 141, 143, 28/145, 147, 149, 150, 163, 165; 223/44, 46; 119/707, 708; 428/4, 5

(56) References Cited

U.S. PATENT DOCUMENTS 1,395,033 A * 10/1921 Bowers ..... 428/4
1,701,514 A * 2/1929 Tashiman ..... 28/147
2,322,060 A * 6/1943 Samuels ..... 28/147
3,105,243 A * 10/1963 Kampfe et al. ..... 28/147
3,413,699 A * 12/1968 Millay ..... 28/147
3,429,019 A * 2/1969 Linstead ..... 28/147
4,366,199 A * 12/1982 Grosjean ..... 428/4
4,418,103 A * 11/1983 Tani et al. ..... 428/4
5,299,719 A * 4/1994 Newgas ..... 223/46
5,611,297 A 3/1997 Veloce
5,962,086 A * 10/1999 Offen ..... 428/4
6,055,714 A * 5/2000 Sproul ..... 28/147
6,237,819 B1 * 5/2001 Ramirez ..... 223/46
6,647,601 B2 * 11/2003 Kim ..... 28/143

* cited by examiner

*Primary Examiner*—A. Vanatta
(74) *Attorney, Agent, or Firm*—Jeffrey S. Melcher; Manelli Denison & Selter, PLLC

(57) ABSTRACT

A process of making a multifibrous article comprising forming a bundle of a desired length comprising a first plurality of fibers of a first flexible material;

a second plurality of fibers of a second flexible material;

wherein the first plurality of fibers and the second plurality of fibers are selectively interspersed within the bundle as desired and are compressibly retained at a position intermittent of the length; and heat treating the bundle at an effective temperature for an effective period of time to effect a desired selective change in physical property characteristics selected from the group consisting of shrinking, singeing and melting of the fibers. The pompon-like article is used as a toy for a cat.

17 Claims, 1 Drawing Sheet

MULTIFIBROUS TOY AND METHOD OF MANUFACTURE THEREOF

This application claims priority to Canadian Patent Application No. 2,368,870, filed on Jan. 22, 2002, the complete disclosure of which are incorporated herein by reference.

FIELD OF THE INVENTION

This invention relates to a process for making pompon-like articles comprising a plurality of distinct fibrous materials and to said articles made by said process for use as toys, particularly cat toys.

BACKGROUND OF THE INVENTION

Canadian Patent No. 2,111,316-Veloce, Frank, issued Sep. 23, 1997, describes a pompon cat toy comprising a mass of soft fibrous material, such as wool or acrylics, having a plurality of pieces of flexible materials, such as aluminum foil, acetate paper, polyethylene or polypropylene sheet interspersed within the mass. The flexible material crumbles or rustles when touched by a cat.

The aforesaid pompons are essentially spherical in shape and do not comprise pluralities of different fibers which have been treated to effect different physical appearances of the fibers within the resultant product.

SUMMARY OF THE INVENTION

In one aspect the invention provides a process of making a multifibrous article comprising forming a bundle of a desired length comprising a first plurality of fibers of a first flexible material;

a second plurality of fibers of a second flexible material;

wherein said first plurality of fibers and said second plurality of fibers are selectively interspersed within said bundle as desired and are compressibly retained at a position intermittent of said length; and heat treating said bundle at an effective temperature for an effective period of time to effect a desired selective change in physical property characteristics selected from the group consisting of shrinking, singeing and melting of said fibers.

Preferably, the process as hereinabove defined further comprises at least one or more pluralities of fibers of a third or more flexible material.

Preferably, the process as hereinabove defined comprises a process wherein said flexible materials are selected from the group consisting of a natural and synthetic material.

The natural material is preferably selected from a wool and cotton; and the synthetic material is selected from a polyethylene, polypropylene, polyester, nylon, acrylic ester and polyamide.

A process as hereinabove defined may further comprise said bundle comprising a non-fibrous flexible material, such as, for example, a plastics material or aluminum in the form of a plurality of sheets.

The fibers are preferably compressibly retained by a retaining member selected from the group consisting of a stretched elastic material, such as a nylons, and metal ring.

Preferably, a process as hereinabove defined has an effective temperature selected from 40°–200° C., preferably, 60°–100° C., and an effective period of time selected from 10–100 seconds.

Preferably, the process as hereinabove defined comprises agitating said bundle at said effective temperature and effective period of time in a hot air tumble dryer.

The first plurality of fibers may be selectively partially shrunk, singed or melted relative to said second plurality of fibers.

The fibers of at least said first plurality may be in the form of a plurality of mesh or net members layered one member upon another. Thus, the roll or reel of fibers may be in the form of a rolled net or mesh which roll is individually unwound and fed in association with a suitable plurality of other nets from distinct rolls in desired arrangement of materials, colors and the like as a multilayer feed to the conical funnel for suitable compression, tying, cutting to length and heat treatment process steps. A typical number of mesh layers is selected from 10–20, preferably 12–16 to give a desired 5 cm diameter product article. The fibers are positioned prior to compression to provide the desired physical appearance and properties in the resultant product.

In a further aspect, the invention provides a multifibrous article as made by a process as hereinabove defined.

Preferably, the article is non-spherical in shape. Further, one or more of the plurality of fibers may be luminescent as to glow in the dark, and may also be of selected desired distinct colors.

BRIEF DESCRIPTION OF THE DRAWINGS

In order that the invention may be better understood, preferred embodiments will now be described by way of example only with reference to the accompanying drawings wherein FIG. 1. is a diagrammatic perspective view of an article according to the invention.

DETAILED DESCRIPTION OF PREFERRED EMBODIMENTS

Figure 1:
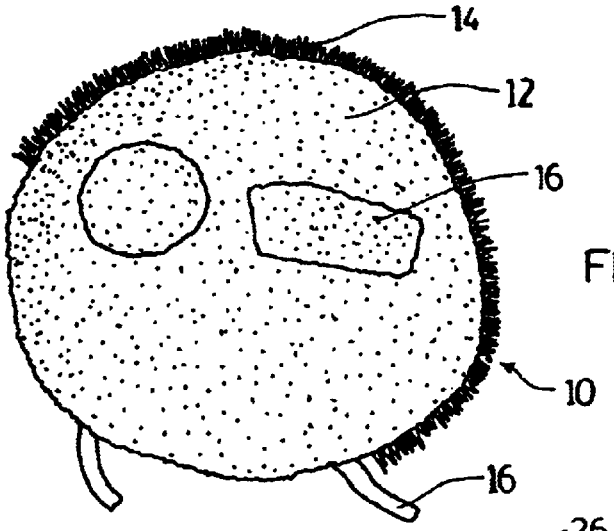

With reference to FIG. 1, this shows generally as 10, an ovoid-shaped bundle of red fibers 12 of an acrylic ester having at essentially one half of the bundle surface, an upstanding array of soft, fluffy white wool fibers 14 and a plurality of aluminum sheets 16. The resultant article has an approximate diameter of 5–6 cm at its widest part.

Figure 2:
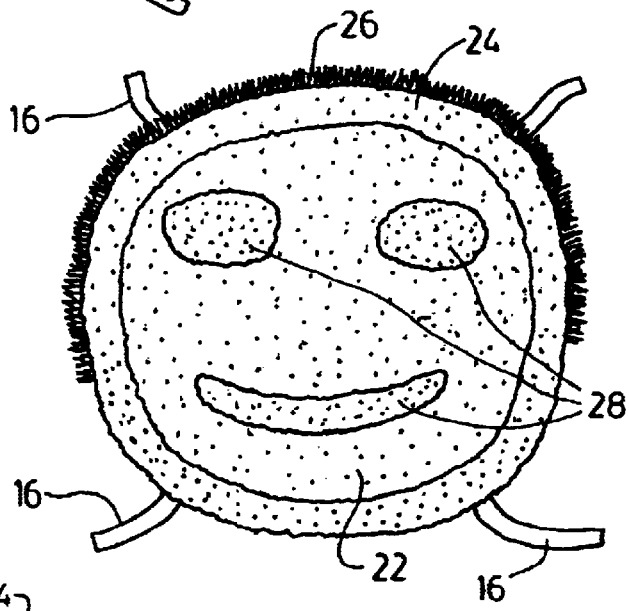
FIG. 2 is a diagrammatic cross-sectional view of an alternative embodiment of an article according to the invention.
Figure 3:
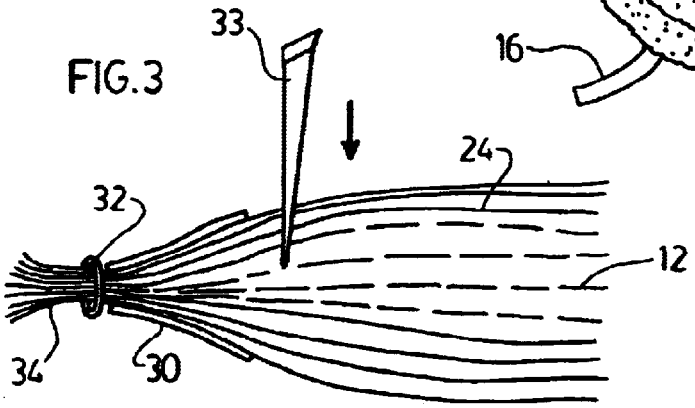
FIG. 3 is a diagrammatic cross-section view of a bundle of fibers within a conical funnel of use in the process according to the invention.

With reference to FIG. 2, this shows generally as 20 a cross-section of compacted relatively firm, red polyethylene fibers 22, surrounded by an outer circle of compacted softer blue nylon fibers 24, to which is interspersed at a part of the surface thereof a bundle of very soft, fluffy wool/cotton mixed fibers 26. Within the body of fibers 22 are discrete bundles of purple polyethylene fibers 26, so disposed and shaped as to give the appearance of eyes and mouth of a face.

Figure 4:
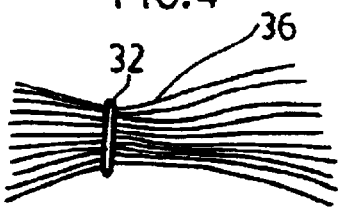
FIG. 4 is a diagrammatic cross-sectional view of a pre-heated bundle prepared in a process according to the invention.
Figure 5:
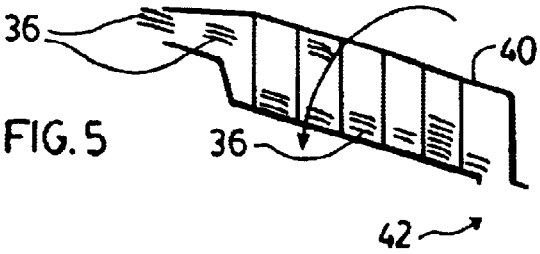
FIG. 5 is a heated tumble drum of use in the practice of the invention; and wherein the same numerals denote like parts.

The aforesaid embodiments are made generally by forming one or more bundles of the respective fibers 12, 14, 22, 24 and 26 suitably interspersed as desired within or adjacent the respective other bundles and aluminum strips, from a continuous reel, roll or strip of fibers or aluminum. The reel is fed through a conical shaped funnel 30 to a desired length for compression and tied by means of a metal hog ring or an elastic string 32, such as for example, nylon. The tied bundle 34 compressed at a central portion 34 of its length is cut by slicing knife 33 to provide bundle 36 as shown in FIG. 4. Bundles 36 are fed to internally screw-threaded tumble rotary heater 40 wherein bundles are air heated to a selected temperature for a selected period of time to selectively either shrink, singe or melt the fibers one type of material relative to another, as desired, to produce product 42. In the examples listed, the treatment was at 190°–210° C. for 25–35 seconds.

The color, material appearance and location of the fibers relative one to another is as desired to simulate the appearance of, say, a small animal, face or mythical creature.

Metal foil, such as aluminum, and/or thicker pieces of wool may be used to confer the appearance of hands, feet, tail, eyes, ears and the like.

Typical fiber treatment temperatures are selected from 60–95° F. and heating times from 10–100 seconds. Clearly, while temperatures and times outside of these ranges may also be efficacious, the person skilled in the art could readily determine these parameters without departing from the spirit of the invention as made and described, herein.

The examples show process details and resultant appearance and physical properties of the respective resultant articles made according to the process of the invention.

EXAMPLES

| Material | Color | Texture |
|---|---|---|
| Wool | White | Soft Fluffy |
| Polyester | Yellow | Compact Soft Fiber |
| Acrylic Ester | Red | Compact Soft Fiber |
| Polyamide | Orange | Compact Hard Fiber |
| Nylon | Blue | Hard Ball |
| Polypropylene | Purple | Compact Hard Fiber |
| Cotton | White | Soft |
| Polyethylene | Red | Hard Fiber |
| Aluminum | — | Sheet |

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

What is claimed is:

1. A process of making a multifibrous article comprising forming a bundle of a desired length comprising a first plurality of fibers of a first flexible material;

a second plurality of fibers of a second flexible material;

wherein said first plurality of fibers and said second plurality of fibers are selectively interspersed within said bundle as desired and are compressibly retained at a position intermittent of said length; and heat treating said bundle at an effective temperature for an effective period of time to effect a desired selective change in physical property characteristics selected from the group consisting of shrinking, singeing and melting of said fibers.

2. A process as defined in claim 1 further comprising at least one or more pluralities of fibers of a third or more flexible material.

3. A process as defined in claim 1 wherein said flexible materials are selected from the group consisting of a natural and synthetic material.

4. A process as defined in claim 3 wherein said natural material is selected from a wool and cotton.

5. A process as defined in claim 3 wherein said synthetic material is selected from a polyethylene, polypropylene, polyester, nylon, acrylic ester and polyamide.

6. A process as defined in claim 1 wherein said bundle further comprises a non-fibrous flexible material.

7. A process as defined in claim 6 wherein said non-fibrous material is selected from a plastics material and aluminum in the form of a sheet.

8. A process as defined in claim 1 wherein said fibers are compressibly retained by a member selected from the group consisting of a stretched elastic material and metal ring.

9. A process as defined in claim 1 wherein said effective temperature is selected from 40°–200° C.

10. A process as defined in claim 1 wherein said effective period of time is selected from 10–100 seconds.

11. A process as defined in claim 1 comprising agitating said bundle at said effective temperature and effective period of time in a tumble dryer.

12. A process as defined in claim 1 wherein said first plurality of fibers are selectively partially melted relative to said second plurality of fibers.

13. A process as defined in claim 1 wherein said fibers of at least said first plurality comprise the form of a plurality of mesh or net members layered one member upon another.

14. A multifibrous article as made by a process as defined in claim 1.

15. An article as defined in claim 14 in the form of a non-spheroidal shape.

16. An article as defined in claim 14 wherein at least said first material is luminescent.

17. An article as defined in claim 14 wherein said first material and said second material are of different colors.

* * * * *